US007563175B2

(12) United States Patent
Nishitani et al.

(10) Patent No.: US 7,563,175 B2
(45) Date of Patent: Jul. 21, 2009

(54) GOLF CLUB

(75) Inventors: Masafumi Nishitani, Tokyo (JP); Masaei Tsurumaki, Niigata (JP)

(73) Assignees: Bridgestone Sports Co., Ltd., Tokyo (JP); K. K. Endo Seisakushao, Niigata (JP)

( * ) Notice: Subject to any disclaimer, the term of this patent is extended or adjusted under 35 U.S.C. 154(b) by 373 days.

(21) Appl. No.: 10/000,219

(22) Filed: Dec. 4, 2001

(65) Prior Publication Data

US 2002/0082117 A1 Jun. 27, 2002

(51) Int. Cl.
*A63B 53/00* (2006.01)

(52) U.S. Cl. ..... 473/324; 473/329; 473/342

(58) Field of Classification Search ..... 473/305, 473/307, 308, 309, 345, 324, 349
See application file for complete search history.

(56) References Cited

U.S. PATENT DOCUMENTS

| | | | | | |
|---|---|---|---|---|---|
| 5,172,913 | A | * | 12/1992 | Bouquet | 473/345 |
| 5,405,136 | A | | 4/1995 | Hardman | |
| 5,423,535 | A | * | 6/1995 | Shaw et al. | 473/291 |
| 5,429,357 | A | | 7/1995 | Kobayashi | |
| 5,669,825 | A | * | 9/1997 | Shira | 473/324 |
| 5,830,084 | A | | 11/1998 | Kosmatka | |
| 5,961,394 | A | * | 10/1999 | Minabe | 473/305 |
| 5,971,867 | A | * | 10/1999 | Galy | 473/345 |
| 6,099,414 | A | * | 8/2000 | Kusano et al. | 473/342 |
| 6,106,412 | A | * | 8/2000 | Kosugi et al. | 473/305 |
| 6,319,148 | B1 | * | 11/2001 | Tom | 473/290 |
| 6,334,817 | B1 | * | 1/2002 | Ezawa et al. | 473/324 |
| 6,339,869 | B1 | * | 1/2002 | Peterson | 29/527.5 |
| 6,368,233 | B1 | * | 4/2002 | Chen | 473/342 |
| 6,739,984 | B1 | * | 5/2004 | Ciasullo | 473/345 |

FOREIGN PATENT DOCUMENTS

| | | | |
|---|---|---|---|
| JP | 59-20182 | A | 2/1984 |
| JP | 05-015620 | A | 1/1993 |
| JP | 05-305162 | A | 11/1993 |
| JP | 06-121845 | A | 5/1994 |
| JP | 06-296714 | | 10/1994 |
| JP | 08-126723 | | 5/1996 |
| JP | 08-126723 | A | 5/1996 |
| JP | 08-131583 | A | 5/1996 |
| JP | 08-243194 | | 9/1996 |
| JP | 09-038249 | | 2/1997 |
| JP | 09-099121 | | 4/1997 |
| JP | 09-099121 | A | 4/1997 |
| JP | 09-192272 | A | 7/1997 |
| JP | 09-248353 | | 9/1997 |
| JP | 09-248353 | A | 9/1997 |
| JP | 10-015123 | A | 1/1998 |
| JP | 10-137372 | A | 5/1998 |
| JP | 10-151231 | A | 6/1998 |

(Continued)

*Primary Examiner*—Tom Duong
(74) *Attorney, Agent, or Firm*—Sughrue Mion, PLLC

(57) ABSTRACT

A golf club includes a shaft and a metal head attached to the shaft. The metal head includes a plurality of metal pieces fixed together by means of laser welding. For example, a face member of the head is manufactured by laser welding three metal pieces; i.e., a center metal piece, an intermediate metal piece, and an outer metal piece.

44 Claims, 11 Drawing Sheets

FOREIGN PATENT DOCUMENTS

| | | | |
|---|---|---|---|
| JP | 10-165546 | A | 6/1998 |
| JP | 11-019255 | A | 1/1999 |
| JP | 11-299938 | | 11/1999 |
| JP | 11-299939 | | 11/1999 |
| JP | 11-313906 | | 11/1999 |
| JP | 2000-157653 | | 6/2000 |

* cited by examiner

GOLF CLUB

BACKGROUND OF THE INVENTION

1. Field of the Invention

The present invention relates to a golf club comprising a shaft and a metal head attached to the shaft.

2. Description of the Related Art

Conventionally, in manufacture of a metal head of a golf club, metal members of the head, such as a face member, a sole member, and a hosel member (hereinafter referred to as "metal pieces"), are fixed to a head body by means of arc welding performed by use of a metal welding rod.

In the conventional method of manufacturing a metal head by means of arc welding, since a welding rod is melted together with two metal pieces to be welded, a bead is formed on the welded portion, and as a result the welded portion has a poor appearance and manufactured heads vary in head weight. In addition, since a large amount of heat is applied to the two metal pieces to be welded together, large crystal grains are formed in the vicinity of the welded portion, making the welded portion becomes hard and brittle. Further, a sink-like imperfection or distortion is produced in the vicinity of the welded portion as a result of thermal contraction.

SUMMARY OF THE INVENTION

In view of the foregoing, an object of the present invention is to provide a metal head for a golf club which is composed of a plurality of metal pieces fixed together, whose welded portion exhibits an improved appearance, which has a reduced variation in weight, whose welded portion and its vicinity do not become hard and brittle during production of the head and in which production of a sink-like imperfection or distortion in the vicinity of the welded portion is prevented during production of the head.

In order to achieve the above object, the present invention provides a golf club comprising: a shaft; and a metal head attached to the shaft, the metal head including a plurality of metal pieces fixed together by means of laser welding.

Since laser welding utilizes energy of a laser beam, welding can be effected without use of a welding rod, and a resultant welded portion has reduced volume and higher accuracy as compared with a portion welded by means of arc welding. In the present invention, since the metal pieces of a golf club head are fixed together by means of laser welding, the above-described drawbacks involved in the conventional method of manufacture performed by means of arc welding are eliminated.

BRIEF DESCRIPTION OF THE DRAWINGS

FIGS. 2A and 2B are views showing a face member of the head of FIG. 1, wherein FIG. 2A is a front view of the face member and FIG. 2B is a cross-sectional view of the face member;

FIGS. 4A and 4B are views showing a sole member of the head of FIG. 3, wherein FIG. 4A is a bottom view of the sole member, and FIG. 4B is a cross-sectional view of the sole member;

FIGS. 5A and 5B are views showing an example sole member of a golf club head according to the present invention, wherein FIG. 5A is a cross-sectional view of the sole member and FIG. 5B is a bottom view of the sole member;

FIGS. 6A and 6B are views showing another example sole member of a golf club head according to the present invention, wherein FIG. 6A is a cross-sectional view of the sole member and FIG. 6B is a bottom view of the sole member;

DESCRIPTION OF THE INVENTION AND PREFERRED EMBODIMENTS

Figure 1:
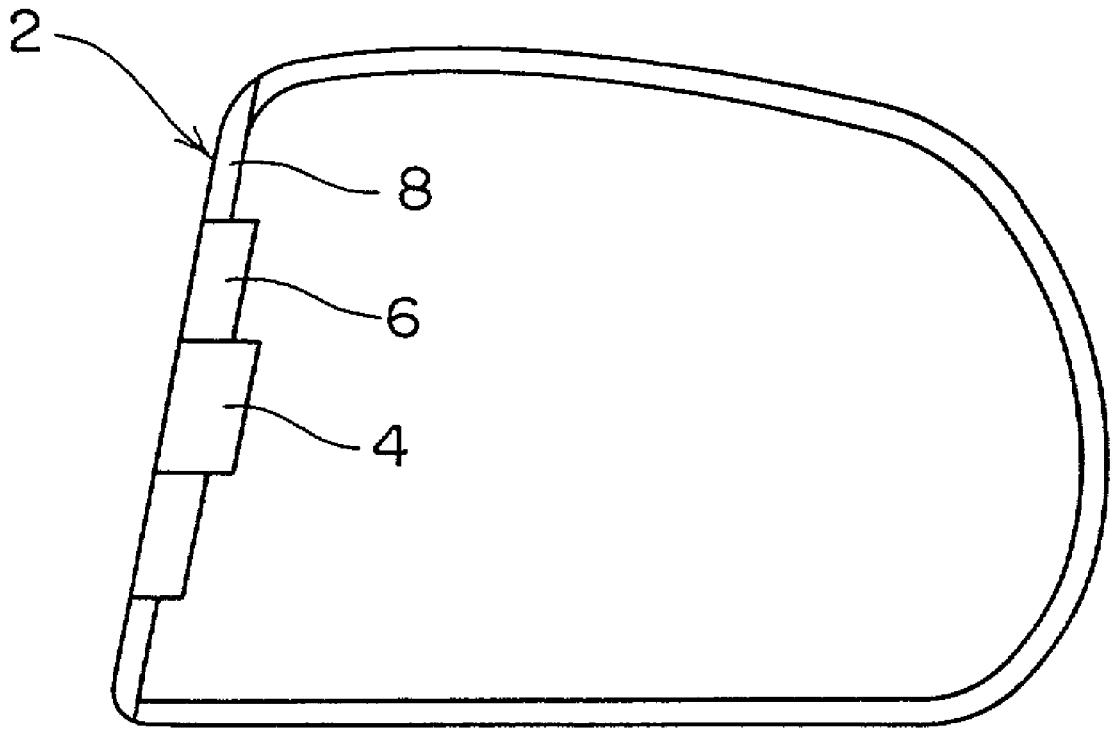
FIG. 1 is a cross-sectional view of a wood-type golf club head according to the present invention.

The present invention will now be described in more detail. In the present invention, no limitation is imposed on the type of laser used for laser welding, but a gas laser such as a CO laser or $CO_2$ laser, or a solid-state laser such as a YAG laser is preferably employed. A YAG laser enables use of a laser beam having a shorter wavelength as compared with a $CO_2$ laser, and in such a case, metal absorbs generated heat at a higher absorption rate. Therefore, a YAG laser is advantageously used in welding of metals, such as aluminum, which are difficult to weld. Alternatively, a $CO_2$ laser having a higher laser output can weld a metal piece having a large thickness.

In laser welding, the width of a laser beam radiated onto a welding zone can be controlled through changing the degree of convergence of the laser beams. Depending on the species and thickness of metal, laser welding can attain a welding width of 1.0 mm or less, preferably 0.2-0.5 mm. Thus, laser welding melts the vicinity of an intended welded zone to a lesser extent as compared with arc welding or similar welding techniques, and generates substantially no heat-induced distortion.

Further, a compounded metal plate fabricated through joining a plurality of metal plates by means of laser welding can be subjected to post-machining (plastic working such as press forming) which utilizes plastic deformation of metal. Thus, the present invention enables machining of such a compounded metal plate into a golf club head, to thereby simplify the manufacturing process of golf club heads. When such a compounded metal plate is manufactured, forged material and rolled material are preferably used as component metal plates of the compounded metal plate. Specifically, precipitation hardened metal and other alloys which increase in hardness through heat treatment are preferred. As is understood from the above, the present invention provides a golf club which comprises a shaft and a metal head attached to the shaft, wherein the metal head includes a portion formed through plastic working of a compounded metal plate which is fabricated through joining a plurality of metal plates by means of laser welding.

In the present invention, in order to laser-weld metal pieces of a golf club head together at high accuracy, the metal pieces are preferably fabricated through punching or laser cutting rather than by mere cutting. Further, milling of cut surfaces of the metal pieces increases the dimensional accuracy of the welded portions of the metal pieces. When the welded portions are desired to have neat appearance, the welded portions may be subjected to finish welding.

In the present invention, a laser welding machine equipped with a 1000 W $CO_2$ laser oscillator can be used to weld a metal piece having a thickness of up to 3 mm, and a laser welding machine equipped with a 2000 W $CO_2$ laser oscillator can be used to weld a metal piece having a thickness of up to 5 mm. Further, a laser welding machine equipped with a 1000 W YAG laser oscillator can be used to weld a metal piece having a thickness of up to 3 mm in the case of stainless steel, and up to 2 mm in the case of titanium alloy or aluminum alloy. Typically, in the case of a wood-type golf club head made of metal, the face portion is the thickest among the portions constituting the head, and, in most cases, is formed from a plate which is made of stainless steel, maraging steel, titanium alloy, or beryllium-copper alloy and has a thickness of 3 mm or less. Therefore, the face portion can be welded properly through use of a laser welding machine employing a 2000 W $CO_2$ laser oscillator.

In the present invention, metal pieces appearing on a common surface of the golf club head can be fixed together by means of laser welding (see FIGS. 1 and 2, which will be described later). In such a case, examples of such a common surface include a face surface, a sole surface, a crown surface, and a side surface.

In the present invention, metal pieces having different thicknesses can be fixed together by means of laser welding (see FIG. 2, which will be described later). In such a case, the metal pieces are rendered flush with each other by use of a jig. When a face portion is composed of a plurality of metal pieces having different thicknesses that are welded together, the elastic modulus of the face portion can be changed locally to thereby increase resilience. Moreover, when a member composed of a plurality of metal pieces having different thicknesses and welded together is used for a sole portion, a crown portion, a side portion, or any other portion, the weight distribution of the head can be changed in order to increase the moment of inertia about the centroidal axis of the head, or to make the position of the centroid deeper or shallower.

In the present invention, a plurality of metal pieces made of different metals can be fixed together by means of laser welding. For example, metal pieces made of different metals can be fixed together by means of laser welding, so long as at least 60% of the respective metal pieces are made of the same metal. When the predominant components of the metal pieces are the same, the metal pieces are close to each other in melting conditions, such as melting temperature and heat conductivity, and therefore laser welding can be performed properly. However, metal pieces made of completely different metals can be laser welded, insofar as they are sufficiently close to each other in melting conditions such as melting temperature and heat conductivity. For example, since the melting temperature of iron (1530°) is very close to that of nickel (1453°), iron and nickel can be fixed together by means of laser welding. That is, two metal pieces made of different metals can be fixed together by means of laser welding when the difference in melting temperature between the metal pieces is 250° C. or less, preferably 120° C. or less.

Figure 5A:
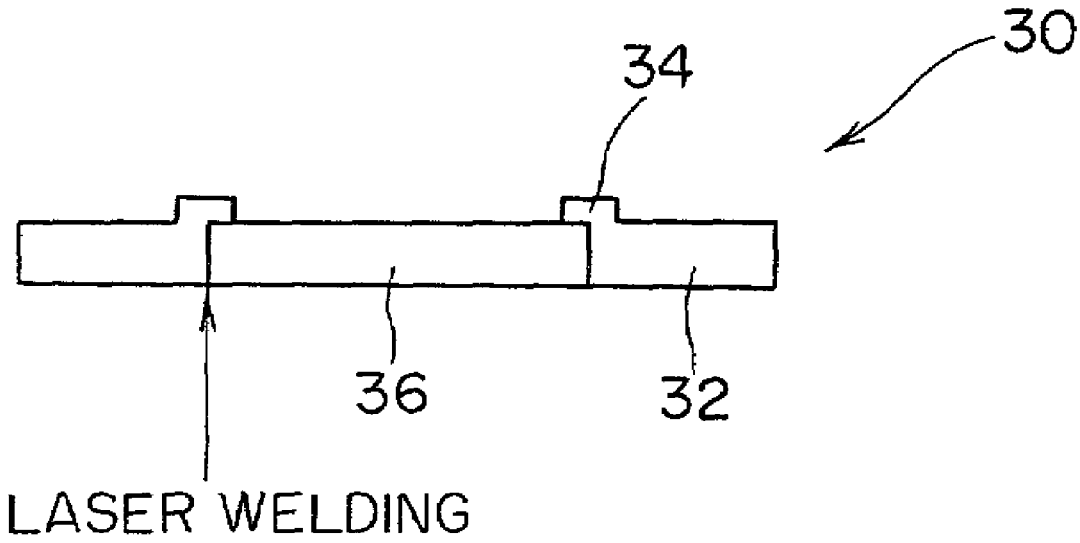
Figure 5B:
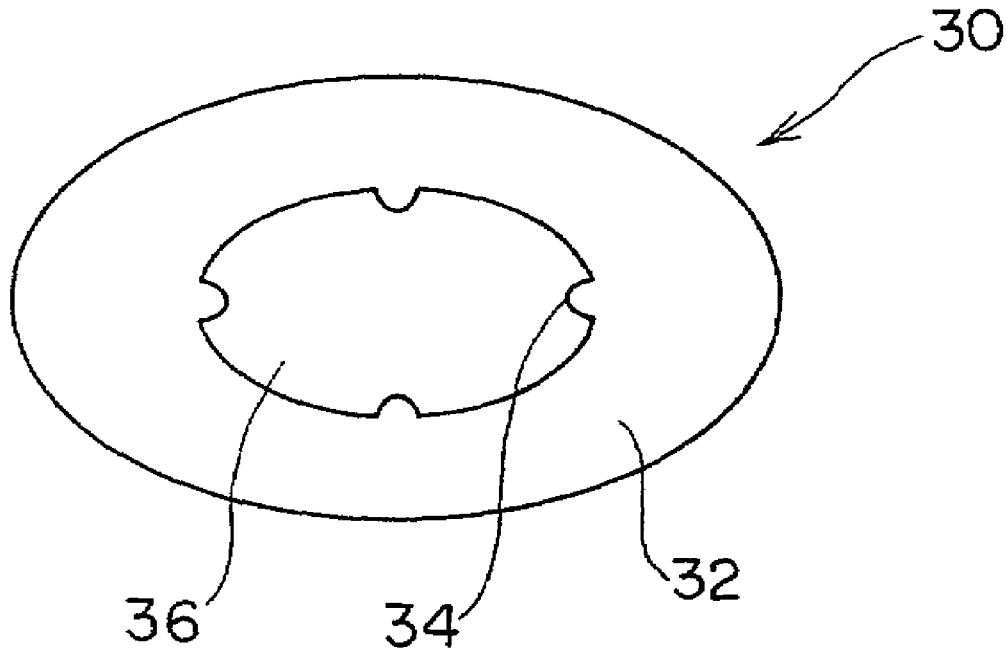
Figure 6A:
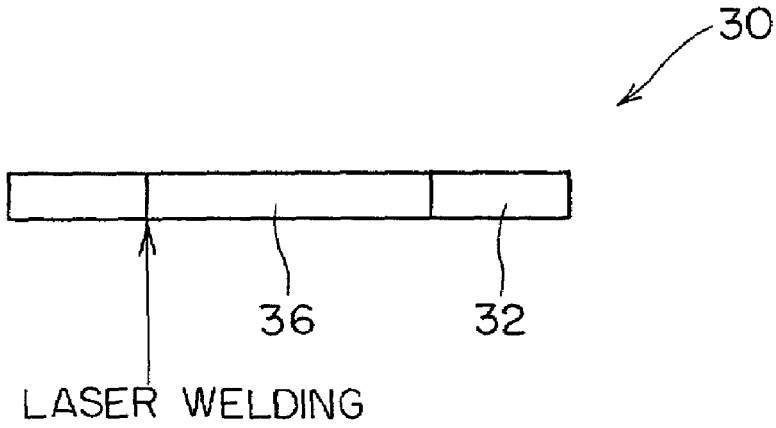
Figure 6B:
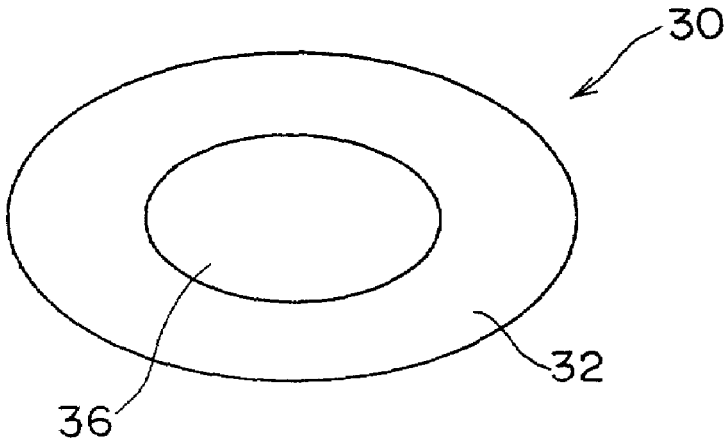
Figure 7:
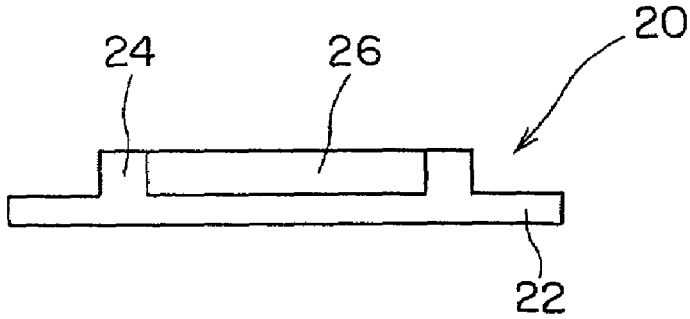
FIG. 7 is a cross-sectional view of a sole member of a conventional golf club head.

Conventionally, when metal pieces are to be fixed together, as shown in FIG. 7 illustrating an example case of a sole member 20, a frame-shaped holding rib 24 is provided on one metal piece 22, and the other metal piece 26 is fixedly disposed inside the holding rib 24 through press-fitting, crimping, screwing, arc welding, or any other suitable fixing means. Therefore, the holding rib 24 must be provided on one metal piece, thereby requiring complex machining. By contrast, in the case of the present invention in which metal pieces are fixed together by means of laser welding, as shown in FIGS. 5A and 5B illustrating an example case of a sole member 30, only small holding ribs 34 are required to be provided on one metal piece 32. The holding ribs 34 have a size necessary for positioning the other metal piece 36 or preventing the other metal piece 36 from coming off. Therefore, machining of the sole member 30 is easy. Moreover, when, as shown in FIG. 5A, the lower surface of the sole member 30 is made flat, the other metal piece 36 can be positioned and prevented from coming off without provision of the holding ribs 34. In such a case, as shown in FIGS. 6A and 6B, the holding ribs can be omitted.

EXAMPLES

Figure 2A:
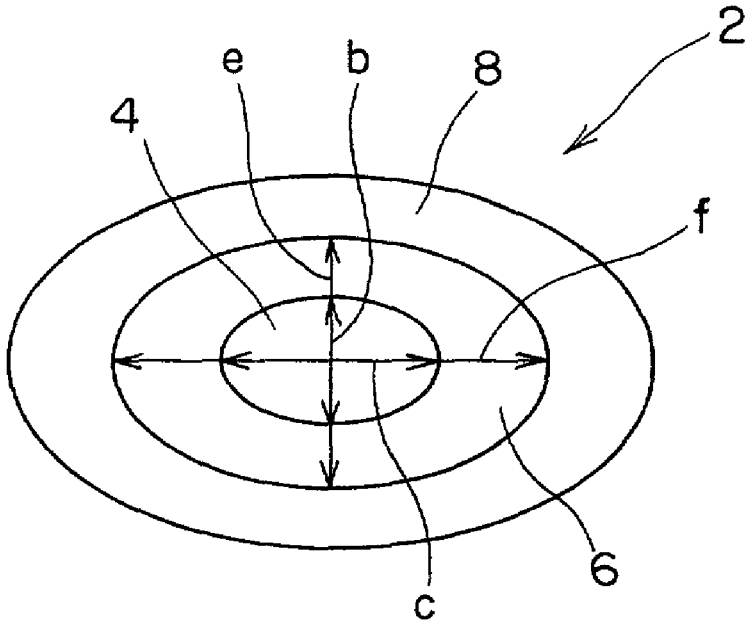
Figure 2B:
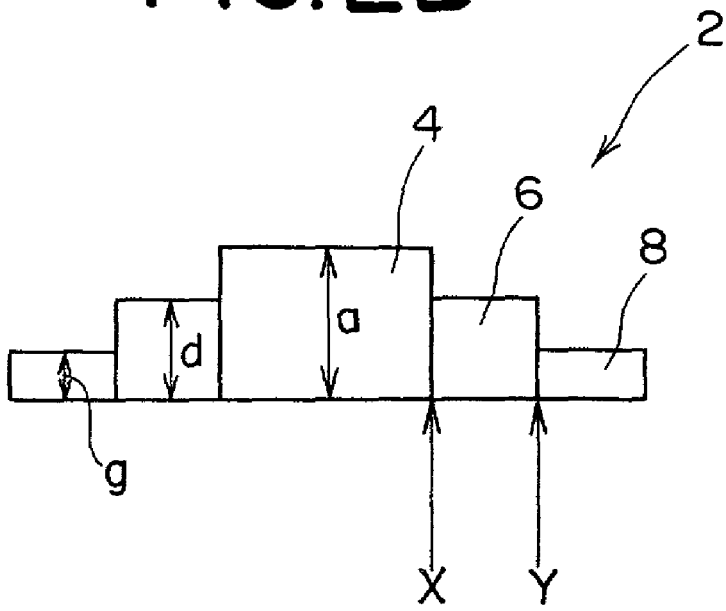

A wood-type golf club head shown in FIG. 1 and having a cavity therein was manufactured. In this case, a face member 2 of the head was fabricated by means of laser welding. As shown in FIG. 2, the face member 2 was manufactured from three metal pieces fixed together; i.e., a center metal piece 4, an intermediate metal piece 6, and an outer metal piece 8. The materials, properties, and dimensions of the center metal piece 4, the intermediate metal piece 6, and the outer metal piece 8 are listed below.

| Center metal piece 4 |
|---|
| Material: titanium alloy (Ti—15Mo—5Zr—3Al)<br>Elastic modulus: 107.6 GPa<br>Hardness: 415 Hv<br>Thickness (a) : 3.0 mm<br>Minor axis dimension (dimension measured along the height direction of the face) (b): 10 mm<br>Major axis dimension (dimension measured along the width direction of the face) (c): 20 mm |

| Intermediate metal piece 6 |
|---|
| Material: titanium alloy (Ti—15V—3Cr—3Sn—3Al) (plate obtained through cold rolling of a plate having a thickness of 3.0 mm)<br>Elastic modulus: 111.5 GPa<br>Hardness: 414 Hv<br>Thickness (d): 2.7 mm<br>Minor axis dimension (dimension measured along the height direction of the face) (e): 25 mm<br>Major axis dimension (dimension measured along the width direction of the face) (f): 40 mm |

| Outer metal piece 8 |
|---|
| Material: titanium alloy (Ti—4.5Al—3V—2Mo—2Fe (SP700) (plate obtained through cold rolling)<br>Elastic modulus: 112 GPa<br>Hardness: 392 Hv<br>Thickness (g): 2.5 mm |

The respective metal pieces 4, 6, and 8 were manufactured through punching such that they could be fitted to one another properly. After the metal pieces 4, 6, and 8 were fitted to one another such that their faces to be subjected to welding become flush with one another, the metal pieces 4 and 6 were welded together and the metal pieces 6 and 8 were welded together, by use of a $CO_2$ laser welding machine (output: 2000 W). The welding was effected through radiation of a laser beam onto a boundary portion (indicated by X in FIG. 2B) between the metal pieces 4 and 6, and onto a boundary portion (indicated by Y in FIG. 2B) between the metal pieces 6 and 8. Since titanium and titanium alloys are easily oxidized, the welding was performed while argon gas was jetted to the welding zone. Thus, a face member 2 was obtained.

After completion of the welding, the face member 2 was subjected to press working so as to form a roll and a bulge (radius: about 10 inches). An inspection was performed so as to check whether a crack was generated in the welded portion during the press working, and revealed that no crack was generated. Subsequently, the face member 2 was welded to a head body, which was then polished and coated. Subsequently, an inspection was performed so as to check whether a sink-like imperfection was formed on the face surface, and confirmed that almost no sink-like imperfection was formed.

Figure 3:
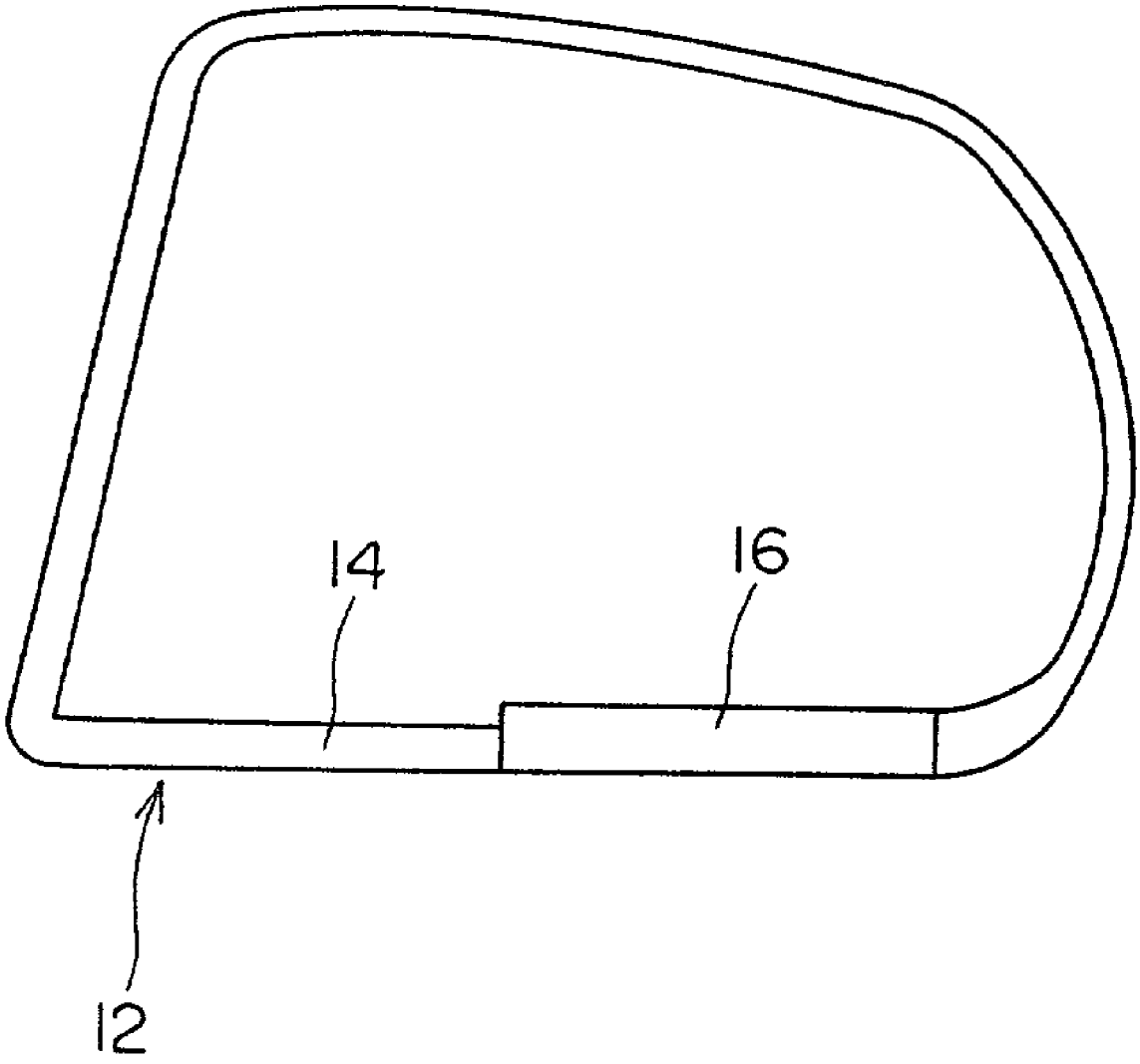
FIG. 3 is a cross-sectional view of another wood-type golf club head according to the present invention.
Figure 4A:
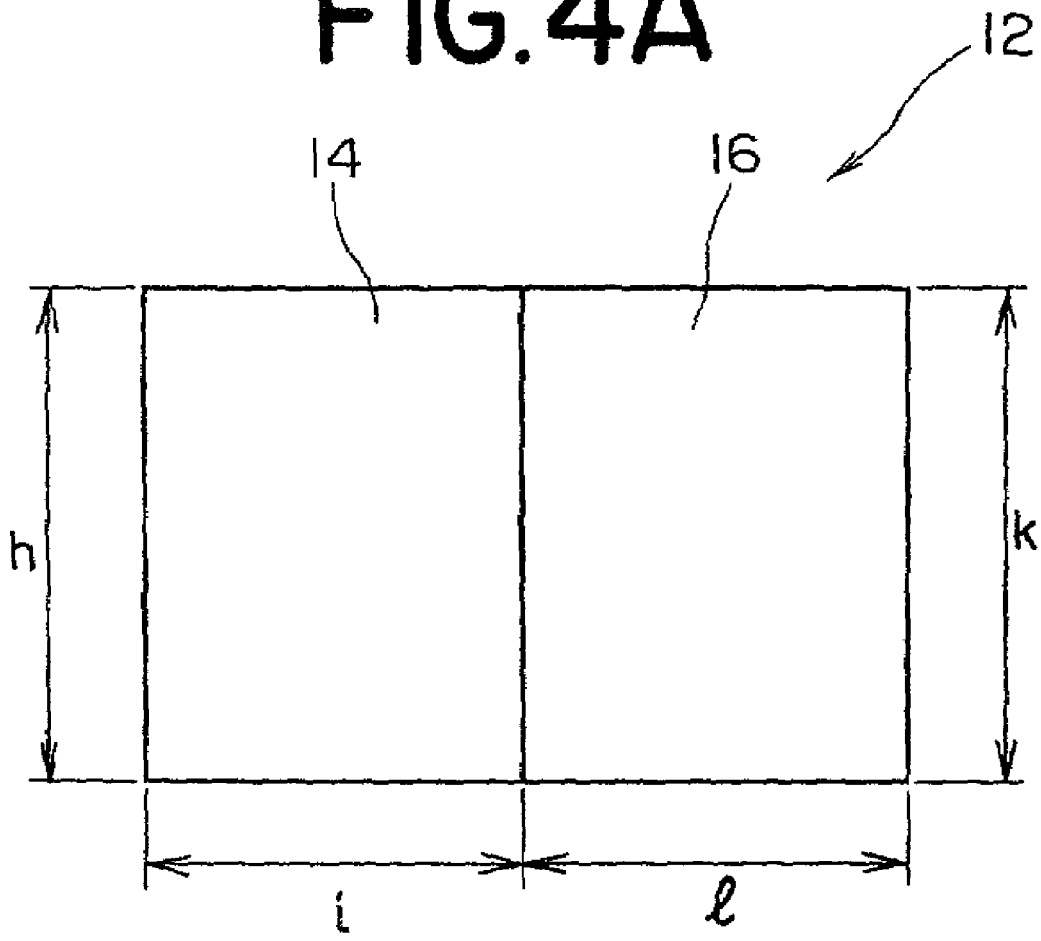
Figure 4B:
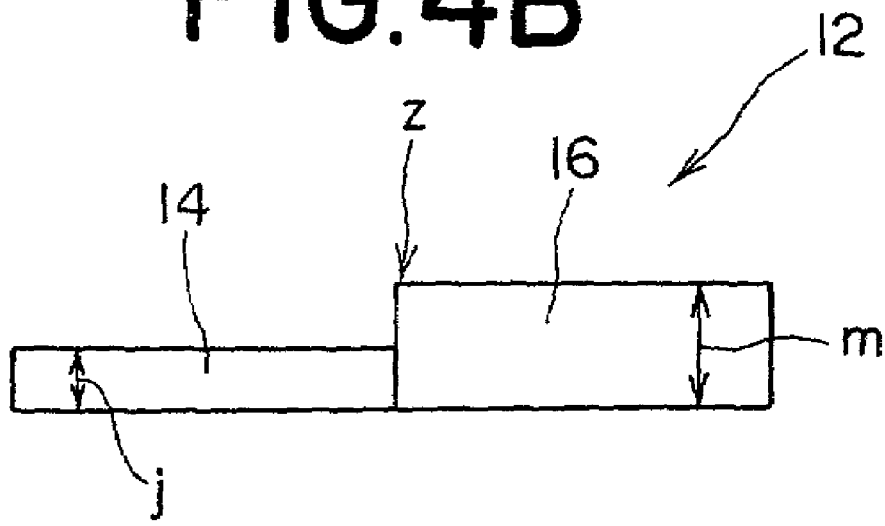

Further, a wood-type golf club head shown in FIG. 3 and having a cavity therein was manufactured. In this case, a sole member 12 of the head was fabricated by means of laser welding. As shown in FIG. 4, the sole member 12 was manufactured from two metal pieces fixed together; i.e., a front metal piece 14 and a rear metal piece 16. The materials and dimensions of the front metal piece 14 and the rear metal piece 16 are listed below.

| Front metal piece 14 |
|---|
| Material: titanium alloy (Ti—15V—3Cr—3Sn—3Al)<br>Height (h): 100 mm<br>Width (i): 80 mm<br>Thickness (j): 1.15 mm |

| Rear metal piece 16 |
|---|
| Material: pure titanium<br>Height (k): 100 mm<br>Width (l): 50 mm<br>Thickness (m): 2.0 mm |

After the front metal piece 14 and the rear metal piece 16 were brought into contact with each other, the front metal piece 14 and the rear metal piece 16 were welded together by use of a $CO_2$ laser welding machine (output: 2000 W). The welding was effected through radiation of a laser beam onto an end portion (portion indicated by Z in FIG. 4B and having a width of about 0.2 to 0.3 mm) of the thicker metal piece (i.e., the rear metal piece 16). Since titanium and titanium alloys are easily oxidized, the welding was performed while argon gas was jetted to the welding zone. Thus, a sole member 12 was obtained. After completion of the welding, the sole member 12 was fixed to a sole opening of the head body by means of laser welding to thereby complete a golf club head.

Variation in weight of the sole member 12 due to welding was investigated for the case in which the front metal piece 14 and the rear metal piece 16 were fixed together by means of laser welding (Examples) and the case in which the front metal piece 14 and the rear metal piece 16 were fixed together by means of TIG welding (Comparative Examples). Table 1 shows the results.

TABLE 1

| | Example 1 | Example 2 | Example 3 | Compara. Example 1 | Compara. Example 2 | Compara. Example 3 |
|---|---|---|---|---|---|---|
| Weight of front metal piece before welding (g) | 41.8 | 42.8 | 43.8 | 42.8 | 43.8 | 43.8 |
| Weight of rear metal piece before welding (g) | 42.8 | 42.8 | 43.8 | 43.8 | 41.8 | 43.8 |
| Weight of sole member after welding (g) | 84.6 | 85.6 | 87.6 | 89.1 | 87.9 | 89.9 |
| Weight increase due to welding (g) | 0.0 | 0.0 | 0.0 | +2.5 | +2.3 | +2.3 |

As can be seen from Table 1, laser welding hardly cause variation in weight, and hardly produces distortion even in the front metal piece 14, which has a small thickness.

A head body was manufactured by use of stainless steel (SUS304), and a sole member was manufactured to be fitted into a sole opening of the head body. As in the above-described case, the sole member was composed of two metal pieces fixed together; i.e., front and rear metal pieces. The materials and dimensions of the front and rear metal pieces are listed below.

| Front metal piece |
|---|
| Material: SUS304<br>Thickness (j): 1.5 mm<br>Rear metal piece<br><br>Material: Be—98% Ni alloy (Be—Ni360)<br>Thickness (j): 1.5 mm |

The metal compositions and melting temperatures of SUS304 and Be—Ni360 are shown below.

| SUS304 |
|---|
| C: 0.08% or less<br>Si: 1.00% or less<br>Mn: 2.00% or less<br>P: 0.045% or less<br>S: 0.030% or less<br>Ni: 8.00% to 10.50%<br>Cr: 18.00% to 20.00%<br>Fe: balance<br>Melting temperature: 1671 to 1700° C. |

| Be—Ni360 |
|---|
| Be: 1.85% to 2.05%<br>Ti: 0.4% to 0.6%<br>Cu: 0.25% or less<br>Ni: balance<br>Melting temperature: 1325° C. |

After the front metal piece and the rear metal piece were brought into contact with each other, the front metal piece and the rear metal piece were welded together by use of a $CO_2$ laser welding machine (output: 2000 W). The welding was effected through radiation of a laser beam onto a boundary portion between the front and the rear metal pieces. After completion of the welding, the thus-obtained sole member was fixed to a sole opening of the head body by means of laser welding, to thereby complete a golf club head.

After coating of the thus-manufactured golf club head, the appearance thereof was checked. Subsequently, a shaft was attached to the golf club head to thereby manufacture a golf club. The thus-manufactured golf club was a wood-type golf club which is used to hit a ball at maximum head speed. A test hit was carried out at a driving range by use of the golf club, and subsequently an inspection was performed so as to check whether a crack was generated in the welded portion. The inspection revealed that no crack was generated in the welded portion, thereby confirming that laser welding does not raise practical problems. Further, inspection of the face and sole portions of the manufactured golf club head revealed that weight increase hardly occurred, and the welded portion was very smooth and neat, since no welding rod was used in the laser welding. Further, since the metal pieces hardly suffered distortion or warpage due to welding, the polishing work and the work for assembling and welding the respective parts of the golf club head could be performed very easily.

Figure 8:
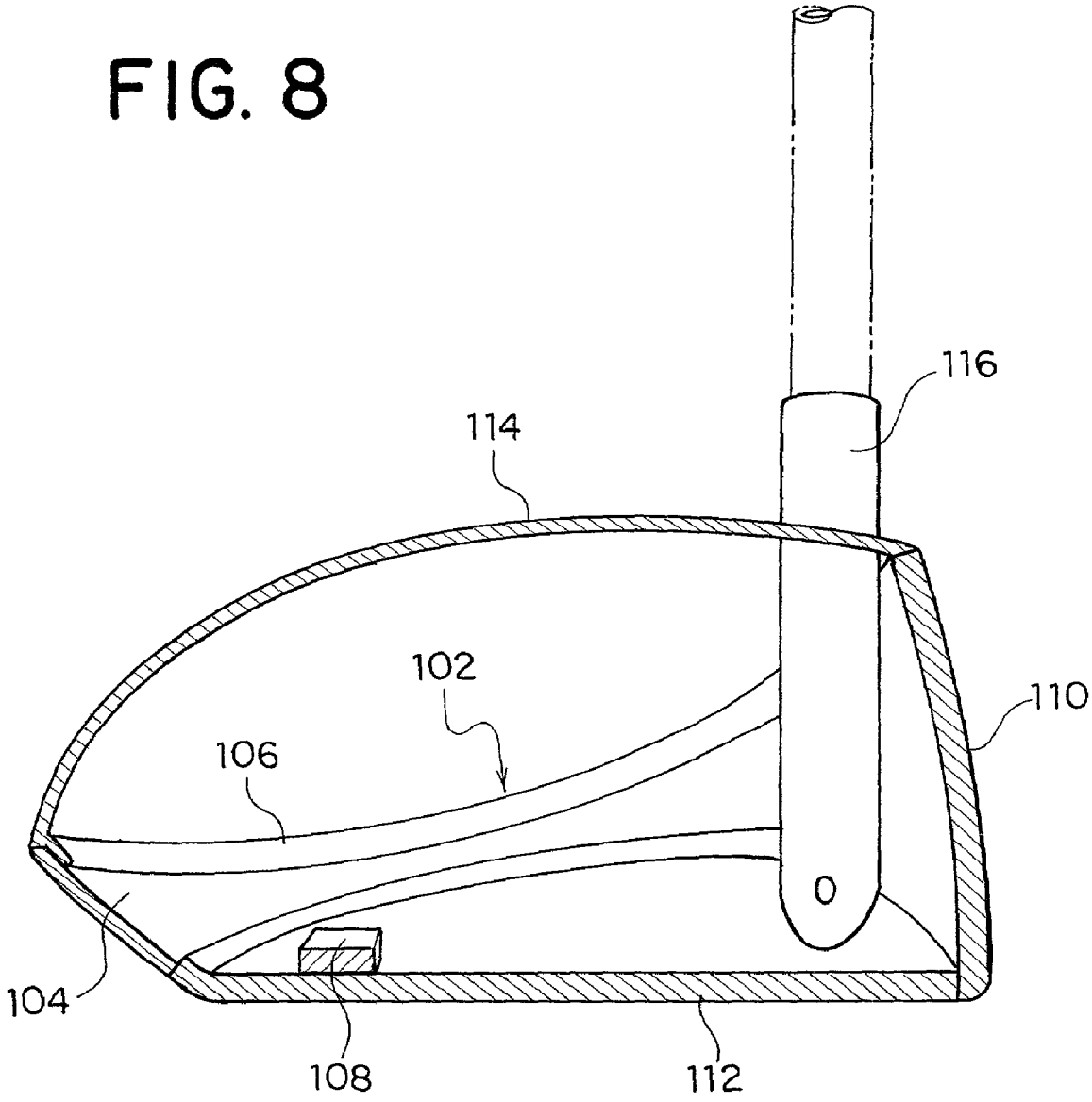
FIG. 8 is a cross-sectional view of another wood-type golf club head according to the present invention.
Figure 9:
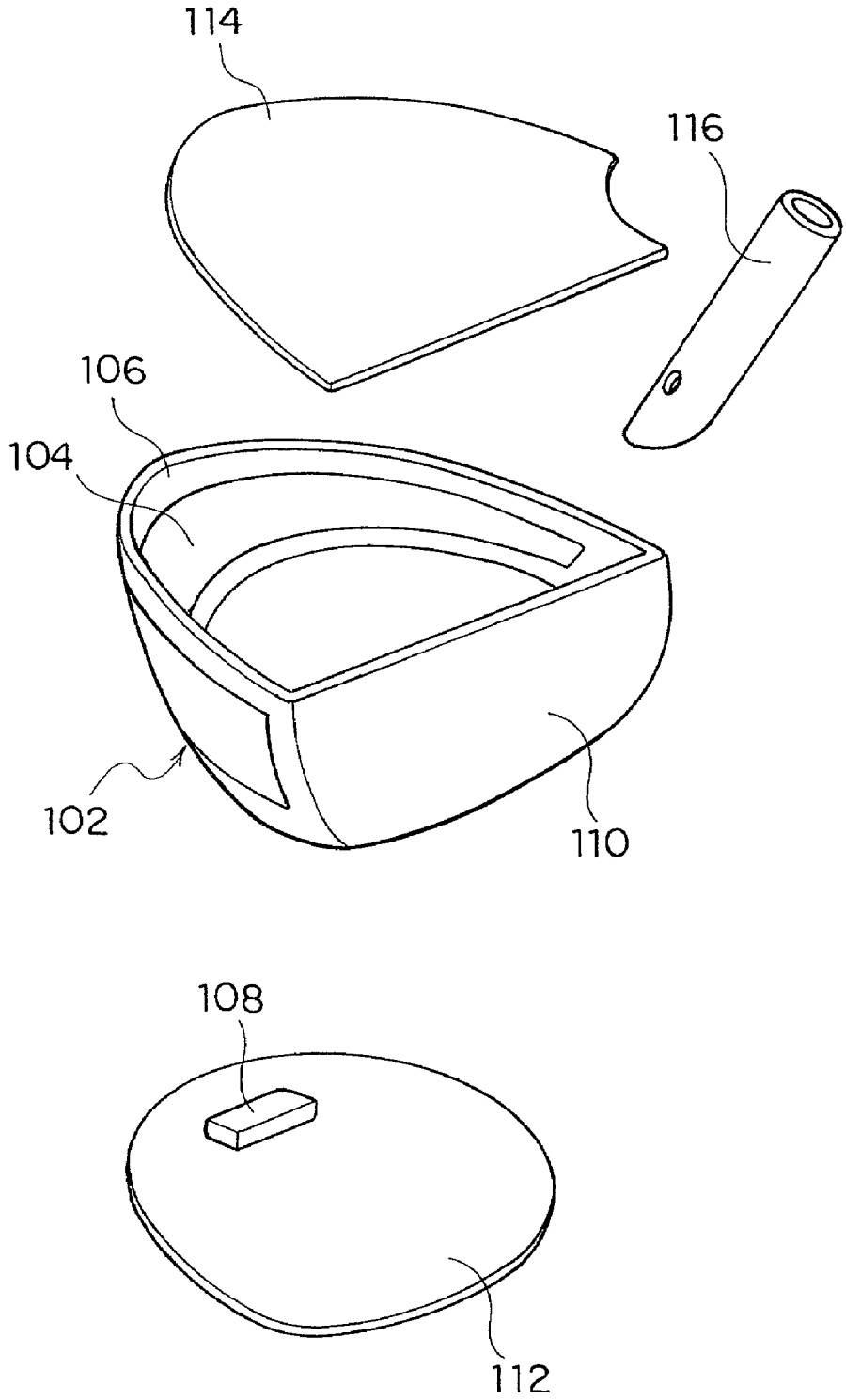
FIG. 9 is an exploded perspective view showing respective members of the golf club head of FIG. 8.

A wood-type golf club head shown in FIGS. 8 and 9 and having a cavity therein was manufactured. In this case, a side member 102 of the head was fabricated by means of laser welding. The side member 102 was manufactured from two metal pieces fixed together; i.e., a center metal piece 104 and an outer metal piece 106. The materials and dimensions of the center metal piece 104 and the outer metal piece 106 are listed below.

| Center metal piece 104 |
|---|
| Material: titanium alloy<br>Thickness: 0.8 mm |

| Outer metal piece 106 |
|---|
| Material: titanium alloy<br>Thickness: 1.2 mm |

The respective metal pieces 104 and 106 were manufactured through punching such that they could be fitted to each other properly. After the metal pieces 104 and 106 were fitted to each other such that their faces to be subjected to welding become flush with each other, the metal pieces 104 and 106 were welded together by use of a $CO_2$ laser welding machine (output: 2000 W). The welding was effected through radiation of a laser beam onto a boundary portion between the metal pieces 104 and 106. Since titanium alloys are easily oxidized, the welding was performed while argon gas was jetted to the welding zone. Thus, a compounded metal plate fabricated through joining a plurality of metal plates by means of laser welding was obtained.

After completion of the welding, the compounded metal plate was subjected to press working so as to plastic-deform the compounded metal plat into the shape of the side member 102. An inspection was performed so as to check whether a crack was generated in the welded portion during the press working, and revealed that no crack was generated.

In the present example, the size of the head can be increased (350 cc or greater) easily through use of a titanium alloy; and a weight-adjusting member 108 can be added. In FIGS. 8 and 9, reference numeral 110 denotes a face member; 112 denotes a sole member; 114 denotes a crown member; and 116 denotes a hosel member.

Figure 10:
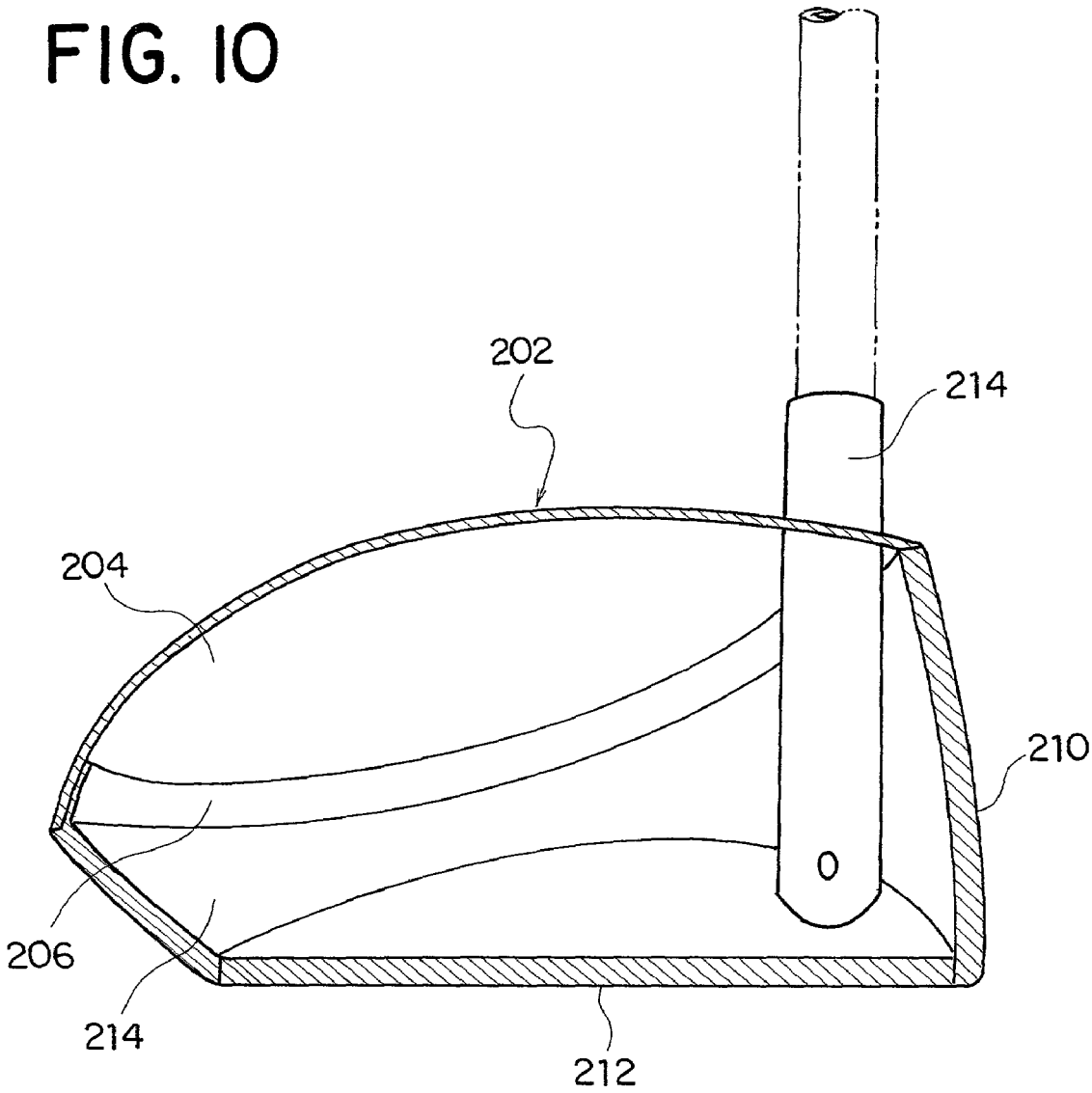
FIG. 10 is a cross-sectional view of another wood-type golf club head according to the present invention.
Figure 11:
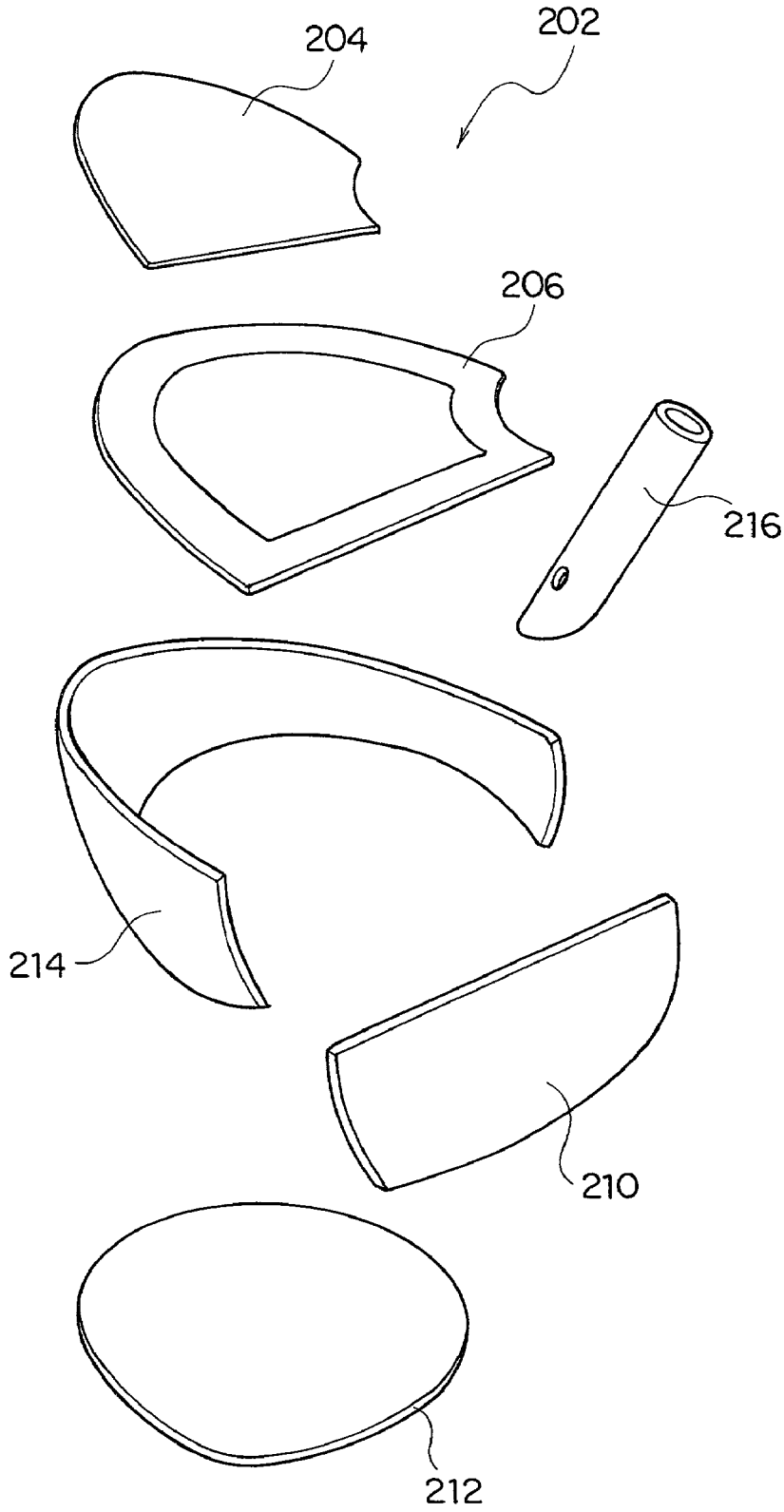
FIG. 11 is an exploded perspective view showing respective members of the golf club head of FIG. 10.

A wood-type golf club head shown in FIGS. 10 and 11 and having a cavity therein was manufactured. In this case, a crown member 202 of the head was fabricated by means of laser welding. The crown member 202 was manufactured from two metal pieces fixed together; i.e., a center metal piece 204 and an outer metal piece 206. The materials and dimensions of the center metal piece 204 and the outer metal piece 206 are listed below.

| Center metal piece 204 |
|---|
| Material: titanium alloy<br>Thickness: 0.8 mm |

| Outer metal piece 206 |
|---|
| Material: titanium alloy<br>Thickness: 1.0 mm |

The respective metal pieces 204 and 206 were manufactured through punching such that they could be fitted to each other properly. After the metal pieces 204 and 206 were fitted to each other such that their faces to be subjected to welding become flush with each other, the metal pieces 204 and 206 were welded together by use of a $CO_2$ laser welding machine (output: 2000 W). The welding was effected through radiation of a laser beam onto a boundary portion between the metal pieces 204 and 206. Since titanium alloys are easily oxidized, the welding was performed while argon gas was jetted to the welding zone. Thus, a compounded metal plate fabricated through joining a plurality of metal plates by means of laser welding was obtained.

After completion of the welding, the compounded metal plate was subjected to press working so as to plastic-deform the compounded metal plat into the shape of the crown member 202. An inspection was performed so as to check whether a crack was generated in the welded portion during the press working, and revealed that no crack was generated.

In the present example, the size of the head can be increased easily through use of a titanium alloy. In FIGS. 10 and 11, reference numeral 210 denotes a face member; 212 denotes a sole member; 214 denotes a side member; and 216 denotes a hosel member.

Figure 12A:
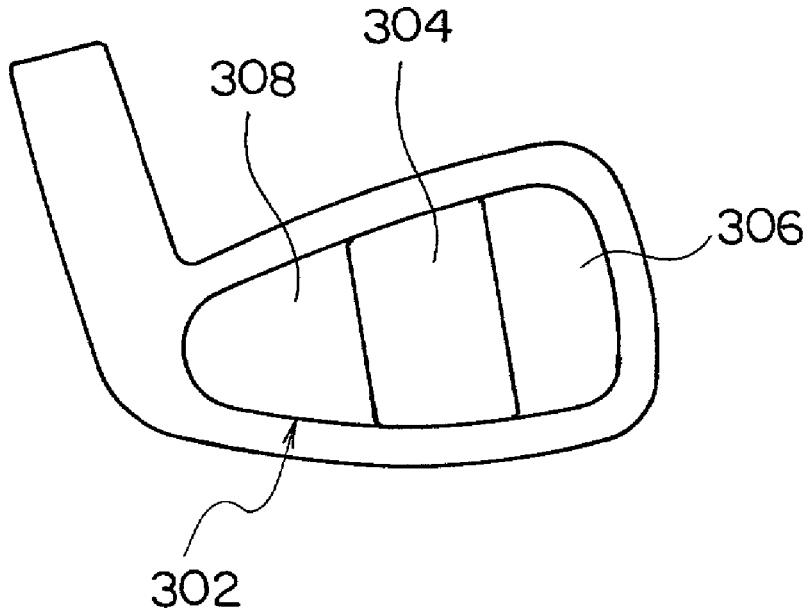
FIG. 12A is a rear view of an iron-type golf club head according to the present invention.
Figure 12B:
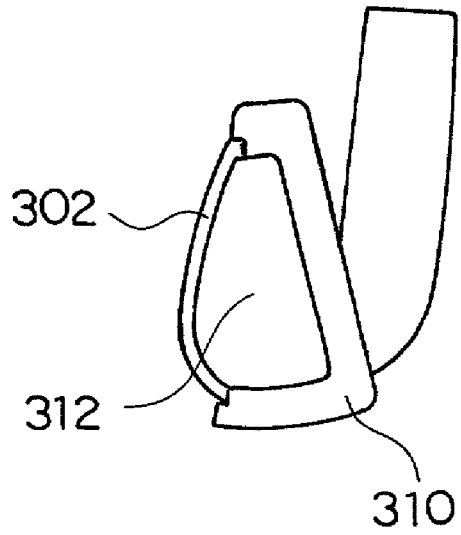
FIG. 12B is a cross-sectional view of the iron-type golf club head.

An iron-type golf club head shown in FIG. 12 and having a cavity therein was manufactured. In this case, a back member 302 of the head was fabricated by means of laser welding. The back member 302 was manufactured from three metal pieces fixed together; i.e., a center metal piece 304, a right-hand metal piece 306, and a left-hand metal piece 308. The materials of these metal pieces are listed below.

| Center metal piece 304 |
| --- |
| Material: SUS 304 (specific gravity: 7.8) |

| Right-hand metal piece 306 and Left-hand metal piece 308 |
| --- |
| Material: Be—Ni alloy (specific gravity: 8.3) |

The metal pieces 304, 306, and 308 were welded together by use of a $CO_2$ laser welding machine (output: 2000 W). The welding was effected through radiation of a laser beam onto a boundary portion between the metal pieces 304 and 306 and a boundary portion between the metal pieces 304 and 308. Thus, a compounded metal plate fabricated through joining a plurality of metal plates by means of laser welding was obtained.

After completion of the welding, the compounded metal plate was subjected to press working so as to plastic-deform the compounded metal plat into the shape of the back member 302. An inspection was performed so as to check whether a crack was generated in the welded portion during the press working, and revealed that no crack was generated.

In FIG. 12, reference numeral 310 denotes a head body made of SUS 304 (specific gravity: 7.8); 312 denotes a cavity.

In the golf club according to the present invention, the metal head has an improved appearance, and variation in weight can be reduced. In addition, the welded portion and portions in the vicinity thereof do not become hard or brittle during production of the head, and no sink-like imperfection or distortion is produced in the vicinity of the welded portion during production of the head.

What is claimed is:

1. A golf club of wood-type having a hollow head body, comprising:

a shaft; and a metal head attached to the shaft, wherein the metal head comprises a body having an opening in which a striking face member is disposed, the striking face member including a plurality of metal pieces; and wherein said plurality of metal pieces are fixed together by laser welding and press forming is performed on the plurality of metal pieces that are fixed together to form a curved surface portion of the striking face member.

2. A golf club according to claim 1, wherein the metal pieces have different thicknesses.

3. A golf club according to claim 1, wherein the metal pieces are made of different metals.

4. A golf club according to claim 3, wherein the difference in melting temperature between the metal pieces is 250° C. or less.

5. A golf club according to claim 3, wherein at least 60% of the respective metal pieces are made of the same metal.

6. The golf club according to claim 1, wherein said plurality of metal pieces are greater than two.

7. The golf club according to claim 1, wherein said plurality of metal pieces include an inner piece and an outer piece surrounding the inner piece.

8. The golf club according to claim 1, wherein the metal pieces fixed together by laser welding form a smooth continuous surface.

9. The golf club according to claim 1, wherein the striking face member is formed by plastic working the metal pieces after the metal pieces are fixed together by laser welding.

10. The golf club according to claim 1, wherein the striking face member is fixed to the opening of the body by welding.

11. The golf club according to claim 1, wherein laser welding is performed in the same plane on the plurality of metal pieces, which are fixed together by the laser welding as flat surfaces prior to the press forming to form the curved surface portion of the striking face member.

12. The golf club according to claim 1, wherein the plurality of metal pieces have the same thickness.

13. A golf club of wood-type having a hollow head body, comprising:

a shaft; and a metal head attached to the shaft, wherein the metal head comprises a body having an opening in which a striking face member is disposed, the striking face member including a portion formed through plastic working of a compounded metal plate fabricated through joining a plurality of metal pieces made of forged or rolled material by laser welding; and wherein the compounded metal plate is fabricated by fixing together by laser welding the metal pieces so that the metal pieces appear on an outside common surface of the striking face member of the head and the plastic working is performed on the compounded metal to form a curved surface portion of the striking face member.

14. A golf club according to claim 13, wherein the compounded metal plate is fabricated by fixing together metal pieces that have different thicknesses.

15. A golf club according to claim 13, wherein the compounded metal plate is fabricated by fixing together metal pieces made of different metals.

16. A golf club according to claim 15, wherein the difference in melting temperature between the metal pieces is 250° C. or less.

17. A golf club according to claim 15, wherein at least 60% of the respective metal pieces are made of the same metal.

18. The golf club according to claim 13, wherein said plurality of metal pieces are greater than two.

19. The golf club according to claim 13, wherein said plurality of metal pieces include an inner piece and an outer piece surrounding the inner piece.

20. The golf club according to claim 13, wherein laser welding is performed in the same plane on the plurality of metal pieces, which are fixed together by the laser welding as flat surfaces prior to the plastic working to form the curved surface portion of the striking face member.

21. The golf club according to claim 13, wherein the plurality of metal pieces have the same thickness.

22. A golf club of wood-type having a hollow head body, comprising:

a shaft; and a metal head attached to the shaft, wherein the metal head comprises a plurality of metal pieces; and wherein the plurality of metal pieces are on an outside common surface of the head and are fixed together by welding, the welding process resulting in a smooth continuous outside common surface, wherein press forming is performed on the plurality of metal pieces that are fixed together by laser welding to form a curved surface of the outside common surface of the head.

23. The golf club according to claim 22, wherein the plurality of metal pieces are made of forged or rolled material.

24. The golf club according to claim 22, wherein the outside common surface is formed by applying post-machining to the metal pieces after the metal pieces are fixed together by laser welding.

25. The golf club according to claim 24, wherein the outside common surface is made by press forming the metal pieces after the metal pieces are fixed together by laser welding.

26. The golf club according to claim 22, wherein laser welding is performed in the same plane on the plurality of metal pieces, which are fixed together by the laser welding as flat surfaces prior to the press forming to form the curved surface portion of the outside common surface.

27. The golf club according to claim 22, wherein the plurality of metal pieces have the same thickness.

28. A golf club of wood-type having a hollow head body, comprising:

a shaft; and a metal head attached to the shaft, wherein the metal head comprises a body having an opening in which a crown member is disposed, the crown member including a plurality of metal pieces; and wherein the metal pieces appear on an outside surface of the crown member and are fixed together by laser welding and press forming is performed on the plurality of metal pieces that are fixed together to form a curved surface portion of the crown member.

29. The golf club according to claim 28, wherein the metal pieces are made of forged or rolled material.

30. The golf club according to claim 28, wherein the crown member is fixed to the opening of the body by welding.

31. The golf club according to claim 28, wherein laser welding is performed in the same plane on the plurality of metal pieces, which are fixed together by the laser welding as flat surfaces prior to the press forming to form the curved surface portion of the crown member.

32. The golf club according to claim 28, wherein the plurality of metal pieces have the same thickness.

33. A golf club of wood-type having a hollow head body, comprising:

a shaft; and a metal head attached to the shaft, wherein the metal head comprises a body having an opening in which a side wall member is disposed, the side wall member including a plurality of metal pieces; and wherein the metal pieces appear on an outside surface of the side wall member and are fixed together by laser welding and press forming is performed on the plurality of metal pieces that are fixed together to form a curved surface portion of the side wall member.

34. The golf club according to claim 33, wherein the metal pieces are made of forged or rolled material.

35. The golf club according to claim 33, wherein the side wall member is fixed to the opening of the body by welding.

36. The golf club according to claim 33, wherein laser welding is performed in the same plane on the plurality of metal pieces, which are fixed together by the laser welding as flat surfaces prior to the press forming to form the curved surface portion of the side wall member.

37. The golf club according to claim 33, wherein the plurality of metal pieces have the same thickness.

38. A golf club of wood-type having a hollow head body, comprising:

a shaft; and a metal head attached to the shaft, wherein the metal head comprises a body having an opening in which a sole member is disposed, the sole member including a plurality of metal pieces; and wherein the metal pieces appear on an outside surface of the sole member and are fixed together by laser welding and press forming is performed on the plurality of metal pieces that are fixed together to form a curved surface portion of the sole member.

39. The golf club according to claim 38, wherein the metal pieces are made of forged or rolled material.

40. The golf club according to claim 1, wherein the striking face member is formed by applying post-machining to the metal pieces after the metal pieces are fixed together by laser welding.

41. The golf club according to claim 40, wherein the striking face member is made by press forming the metal pieces after the metal pieces are fixed together by laser welding.

42. The golf club according to claim 38, wherein the sole member is fixed to the opening of the body by welding.

43. The golf club according to claim 38, wherein laser welding is performed in the same plane on the plurality of metal pieces, which are fixed together by the laser welding as flat surfaces prior to the press forming to form the curved surface portion of the sole member.

44. The golf club according to claim 38, wherein the plurality of metal pieces have the same thickness.

* * * * *